US005275699A

United States Patent [19]

Allan et al.

[11] Patent Number: 5,275,699

[45] Date of Patent: Jan. 4, 1994

[54] COMPOSITIONS AND METHODS FOR FILLING DRIED CELLULOSIC FIBERS WITH AN INORGANIC FILLER

[75] Inventors: G. Graham Allan; John P. Carroll, both of Seattle, Wash.

[73] Assignee: University of Washington, Seattle, Wash.

[21] Appl. No.: 957,683

[22] Filed: Oct. 7, 1992

[51] Int. Cl.[5] ..... D21H 17/67

[52] U.S. Cl. ..... 162/181.2; 162/9; 162/181.3; 162/181.7; 162/182; 162/183

[58] Field of Search ..... 162/181.2, 181.3, 181.1, 162/181.7, 182, 9, 183

[56] References Cited

U.S. PATENT DOCUMENTS

| | | | |
|---|---|---|---|
| 2,399,982 | 5/1946 | Britt | 162/181.7 |
| 2,583,548 | 1/1952 | Craig | 162/9 |
| 3,029,181 | 10/1962 | Thomsen | 162/181.2 |
| 4,510,020 | 4/1985 | Green et al. | 162/9 |
| 5,096,539 | 3/1992 | Allan | 162/9 |
| 5,122,230 | 6/1992 | Nakajima | 162/181.2 |

FOREIGN PATENT DOCUMENTS

| | | | |
|---|---|---|---|
| 588278 | 1/1978 | U.S.S.R. | 162/181.2 |

*Primary Examiner*—Peter Chin
*Attorney, Agent, or Firm*—Seed and Berry

[57] ABSTRACT

There is disclosed a filled cellulosic fiber composition, as well as a method for filling dried cellulosic fibers with an inorganic filler by contacting the dried fibers with a first salt solution, followed by contact with a second salt solution. The first and second salt solutions combine to form a precipitate within the cell wall of the cellulosic fibers. The filled cellulosic fiber composition may be made into a variety of paper products, including paper, having a high filler content. The precipitates of the present invention include carbonates, phosphates, silicates and borates of aluminum, barium, calcium, magnesium and zinc. The first salts include carbonates, phosphates, silicates and borates of sodium, ammonium, potassium and lithium, and the second salts include chlorides, nitrates, and sulfates of aluminum, barium, calcium, magnesium and zinc. In a preferred embodiment, the first salt is sodium carbonate, the second salt is calcium nitrate or calcium chloride, and the precipitate is calcium carbonate.

19 Claims, 1 Drawing Sheet

COMPOSITIONS AND METHODS FOR FILLING DRIED CELLULOSIC FIBERS WITH AN INORGANIC FILLER

GOVERNMENTAL SUPPORT

This invention was made with government support under USDA grants 9033574-5208 and 9133574-5976, and the government may have certain rights in the invention.

DESCRIPTION

1. Technical Field

The present invention is generally directed to a filled cellulosic fiber composition and a method for filling dried cellulosic fibers with an inorganic filler, and more specifically, to a method for filling dried cellulosic fibers utilizing a first salt and a second salt which combine to non-uniformly impregnate the fibers with the inorganic filler to yield the filled cellulosic fiber composition.

2. Background of the Invention

The increasing cost of virgin pulp and the energy associated with its transformation to paper are familiar problems to the paper industry. The boom in hardwood utilization, the optimization of high-yield pulping processes, and the ongoing conversion to alkaline sizing are only a few examples of the many attempts made in recent years to make the production of paper more economical. A further example, and one that has proved particularly economical, is the replacement of pulp fibers with less expensive filler materials. Such high-filler content papers are referred to as "ultrahigh-ash paper," with calcium carbonate commonly employed as the filler.

Existing technology combines pulp fibers and filler in a manner such that the filler is placed in at least one of three locations. The first of these locations is between the fibers. This is accomplished by mixing fibers and particulate filler in a water suspension. This mixture is then subjected to the usual papermaking process whereby the suspended solids (fibers and filler) are collected on a moving wire mesh as the water is removed. However, a major constraint in making ultrahigh-ash paper with the filler located between the fibers is the impairment of interfibrillar bonding, and the resulting decrease in paper strength.

In an attempt to obviate the loss of paper strength associated with locating the filler between the fibers, a process for introducing the filler at a second location has been developed. In this second process, the filler is loaded within the hollow core of the fiber, or lumen, by a technique called "lumen-loading." U.S. Pat. No. 4,510,020. In this procedure, fibers with uncollapsed lumens are suspended in a concentrated mixture of filler and water. During vigorous agitation the small filler particles are physically forced through large apertures in the cell wall (called pits) and into the lumen. While paper made from such lumen-loaded fibers are stronger than the corresponding papers in which the filler is located between the fibers and outside of the lumen, the process is uneconomical because it involves the recirculation of immense quantities of unused filler.

To avoid the drawbacks of the lumen-loaded technology, filling of pulp fibers with filler at a third location has now been disclosed-that is, within the cell wall of the fiber. In this third procedure, the fibers must initially be "never-dried." U.S. Pat. No. 5,096,539. In short, the uniform microporous structure created during the pulping of the original fiber is retained in never-dried fibers. This microporous structure results from the dissolution of the lignin, hemicelluloses and any extractives by the pulping liquor, and consists of square rods of cellulose molecules. The rods are believed to be about 35 Å in size on the side and arranged in lamellar plates. The volume between these plates and within the cell wall can be as much as 2 mL per gram of cellulose. If the never-dried fibers are impregnated with a solution of a first salt (such as calcium chloride) this internal cell wall volume becomes filled with that solution. When these impregnated fibers are immersed in a second salt solution (such as sodium carbonate) a precipitate of calcium carbonate is uniformly created throughout the cell wall. The physical properties of paper made from these fibers are comparable to those prepared by the lumen-loading technology, and are superior to those where the filler is located between the fibers. Allan, Negri and Ritzenthaler, TAPPI J. 75(3):239–244, 1992.

While filling the cell wall of never-dried fibers has now been demonstrated, prior attempts to locate filler within the cell wall of dried fibers has uniformly failed. This failure is primarily due to the structural differences between dried and never-dried fibers. Never-dried fibers have an internal area of about 1,000 $m^2$ per gram of cellulose. Upon drying, this area and the associated internal volume are lost. Specifically, the area of the dried fibers drops to about 1 $m^2$ per gram of cellulose, and the dried fibers are essentially nonporous. During the drying process, the surface tension forces of the departing water draw the lamellae in the cell wall of the never-dried fibers together with tremendous force. The lamellae then become hydrogen-bonded into a solid mass of cellulose. While it is possible to partly re-swell the dried fibers so as to restore some of the internal volume of the cell wall, only a part of the original internal volume can be recovered. In addition, the original uniform multilamellar structure with the cellulose rod plates is not recovered upon re-swelling. Instead, the cell wall of dried fibers primarily consists of nonuniform, thick multilamellar aggregates of bonded lamellae, which are not substantially disrupted by re-swelling agents. A considerable amount of research has been devoted to re-swelling dried fibers, and re-swelling of cellulose by treatment with strong sodium hydroxide solutions is the most common agent utilized for this purpose. However, despite these efforts, only a small amount of filler (typically less than 10% by weight) can be introduced into and retained within the cell wall of either dried or re-swollen fibers.

Accordingly, there exists a need in the art for a method of filling the cell wall of dried and/or re-swollen cellulosic fibers with a filler. There also exists a need for a fiber having a filler distributed within the cell wall, as well as a need for paper products made therefrom. The paper made from such filled fibers should be economical, of high opacity and strength, and contain a high level of filler within the fiber cell wall and firmly attached or bound to the fiber. Furthermore, the method of filling should achieve high filler levels utilizing dried cellulosic fibers from a variety of sources, including softwoods, hardwoods, annual plants (such as sugar cane) and grasses, and wastepapers originating therefrom.

SUMMARY OF THE INVENTION

It is an object of the present invention to provide a method of filling the cell wall of dried and/or re-swollen cellulosic fibers with a filler. It is a further object to provide a filled fiber composition wherein filler is non-uniformly distributed within the cell wall of the fiber. Yet a further object is to provide filled cellulosic fibers for making paper products having industry acceptable opacity, brightness, strength and a high retained filler level. The present invention satisfies these objectives, and provides further related advantages.

In one embodiment, the present invention discloses a method for making a filled cellulosic fiber by contacting dried cellulosic fiber with a first salt, followed by contact with a second salt. The first salt is characterized by having an alkaline pH in water, and the second salt is characterized by having a neutral or acid pH in water. The first and second salts combine to form a precipitate within the cell wall of the cellulosic fiber to yield the filled cellulosic fiber and a water-soluble co-product. The water soluble co-product of the precipitate, as well as any unbound or unattached precipitate, may be removed from the filled cellulosic fibers by subsequent water washings. The precipitates of the present invention are selected from the group consisting of carbonates, phosphates, silicates and borates of aluminum, barium, calcium, magnesium and zinc. The first salts are selected from the group consisting of water-soluble carbonates, phosphates, silicates and borates of sodium, ammonium, potassium and lithium, and the second salts are selected from the group consisting of water-soluble chlorides, nitrates and sulfates of aluminum, barium, calcium, magnesium and zinc. In the method of the present invention, it is essential that the dried fibers be initially contacted with the first salt, followed by contact with the second salt. Reversing this order fails to achieve elevated filler levels for the filled cellulosic fibers.

In a further embodiment, the present invention is directed to a method for producing a filled cellulosic fiber from a dried cellulosic fiber by contacting the dried cellulosic fiber with an alkaline aqueous solution containing a first salt to yield a wetted fiber, followed by contacting the wetted fiber with a neutral or acidic aqueous solution containing a second salt. By this method, a precipitate is formed within the cell wall of the fiber to yield the filled cellulosic fiber and a water-soluble co-product. The water-soluble co-product, as well as unbound or unattached precipitate, may then be removed by subsequent washing with water. The filled cellulosic fibers may be made directly into paper products (such as writing paper) by conventional techniques, or dried for ease of storage and/or transportation.

In yet a further embodiment of the present invention, a filled cellulosic fiber composition is disclosed. The filled cellulosic fiber is characterized by having an inorganic filler located non-uniformly within the cell wall of the cellulosic fiber, and having a filler content after vigorous water washing of at least 10% by weight. The filled cellulosic fiber is further characterized by having an internal cell wall volume which has substantially collapsed due to loss of water upon drying prior to filling the cellulosic fiber with the inorganic filler of the present invention.

DETAILED DESCRIPTION OF THE INVENTION

Figure 1A:
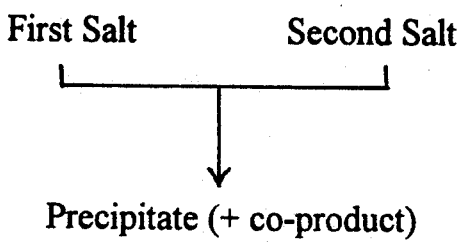
FIG. 1(*a*) is a graphical representation of the process of the present invention for forming the precipitate, and FIG. 1(*b*) illustrates a preferred embodiment where calcium carbonate is the precipitate and the first and second salts are sodium carbonate and calcium nitrate, respectively.

In one embodiment, the present invention discloses a method for filling dried cellulosic fibers with an inorganic filler to produce filled cellulosic fibers. In another embodiment, the present invention discloses filled cellulosic fibers (and paper products made therefrom) where at least a portion of the inorganic filler is non-uniformly distributed throughout the cell wall of the cellulosic fibers. As used herein, the term "dried cellulosic fibers" means that the cellulosic fibers have been dried to an extent such that the cell wall volume of the fibers have substantially collapsed due to loss of water upon drying. A dried cellulosic fiber which has been re-swollen with a swelling agent (referred to herein as "re-swollen fibers") is included within this definition. The cellulosic fibers may be obtained from a variety of sources, including, but not limited to, wood (both softwood and hardwood fibers), annula plants (such as sugar cane) and grasses, and wastepapers originating therefrom.

Dried cellulosic fibers are formed by removing water from never-dried cellulosic pulp which, in turn, is formed by removing the lignin and hemicellulose and extractives (if any) from the cellulosic fibers during pulping. Never-dried cellulosic pulp is a composite of several hundred concentric lamellae of cellulose microfibrils. Each lamella is separated from the others and is about 35 Å in width. Never-dried cellulosic pulp has a surface area of at least about 1,000 $m^2/g$. Upon drying, the surface area reduces to about 1 $m^2/g$. Due to the collapse of the cell wall volume upon drying, prior filling techniques of dried cellulosic fibers have proved unsuccessful in obtaining high filler levels.

The present invention overcomes this problem by providing a method for filling dried cellulosic fibers with an inorganic filler to produce filled cellulosic fibers having a high filler level or content. As used herein, the term "filled cellulosic fibers" means that the fibers contain at least 10% by weight of firmly attached or bound inorganic filler, and more preferably at least 15% by weight inorganic filler, and most preferably at least 20% by weight inorganic filler. In the practice of the present invention, the majority of the filler is formed within cell wall voids of the dried fiber which are unexpectedly created upon contact with the first salt, but which are not created if the second salt is used in place of the first salt. While contact of the dried cellulosic fibers with the first salt does not restore the internal volume of the dried fibers to that of never-dried fibers (where the lamellar plates are completely separated), substantial nonuniform swelling of the dried cellulosic fibers does occur (i.e., a portion of the lamellar plates are completely separated, a portion remain collapsed, and a portion are in a state somewhere between these two states). Such nonuniform swelling by the first salt of this invention is surprising since treatment with sodium hydroxide alone fails in this regard. The ability of the first salt of the present invention to achieve this result is believed responsible for the nonuniform filling of the cell wall of the dried cellulosic fibers. The amount of inorganic filler in the filled cellulosic fibers may be determined by TAPPI Standard T 211 om-85: Ash in Wood and Pulp.

In a preferred embodiment of the present invention, the first step of the method of filling involves contacting the dried cellulosic fibers with a first salt. Prior to contacting the dried cellulosic fibers, the first salt is preferably added to water to yield a first aqueous salt solution. As used herein, the term "contacting" means that a sufficient amount of the first aqueous salt solution is applied to the dried cellulosic fibers such that the fibers are thoroughly wetted or soaked with the salt solution. Such application is preferably accomplished by immersing, impregnating or soaking the dried cellulosic fibers in the aqueous salt solution, but may also be accomplished by spray application of the aqueous salt solution, or other suitable techniques.

Figure 1B:
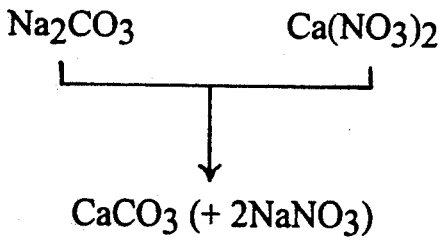

Following contacting the dried cellulosic fibers with the first aqueous salt solution, the wetted fibers are then contacted with a second aqueous salt solution such that the desired precipitate is formed, thus filling the cellulosic fibers with the inorganic filler. As a co-product of precipitate formation, a water-soluble salt is also formed which may be removed from the filled cellulosic fibers by one or more subsequent washing steps. As illustrated in FIG. 1(*a*), the first salt and the second salt combine to from a precipitate and a water soluble co-product. Referring to FIG. 1(*b*), the water-soluble salt (i.e., sodium nitrate) is formed as a co-product to the reaction between sodium carbonate (i.e., the first salt) and calcium nitrate (i.e., the second salt) to form the calcium carbonate filler (i.e., the precipitate). In the practice of the present invention, it is critical that the dried cellulosic fibers are initially contacted with the first salt, and then followed by contact with the second salt. Reversing this order (i.e., contacting the dried cellulosic fibers initially with the second salt, followed by contact with the first salt) fails to achieve filled cellulosic fibers having high filler levels.

Alternatively, one or both of the first and second salts may be applied to the cellulosic fibers in a dry form. For example, following contact of the dried cellulosic fibers with the first aqueous salt solution, the wetted fibers may be contacted with the second salt by, for example, applying the second salt in dry form to the wetted fibers. Furthermore, the dried cellulosic fibers may be formed into sheets of wet lap, and then contacted with the first and/or second salts (in dry or aqueous form). In the practice of the present invention, utilizing aqueous first and second salt solutions is preferred since it offers significant advantages, particularly with regard to ease of handling and uniformity of application.

Following contact of the cellulosic fibers with the first salt, the second salt, and the resulting formation of the precipitate, the filled cellulosic fibers may then be washed to remove any unreacted first and/or second salt, the water soluble salt co-product, and any unattached or unbound precipitate. Appropriate washing steps are illustrated in the examples herein.

As mentioned above, in the practice of the present invention, it is essential that the dried cellulosic fibers initially be contacted with the first salt, followed by contact with the second salt. Reversing this order fails to achieve the remarkable filler levels for the filled cellulosic fibers. The first salt of this invention may generally be characterized as having a pH in water of greater than 7 (i.e., pH<7), and the second salts may generally be characterized as having a pH in water of less than or equal to 7 (i.e., pH≦7). In other words, an aqueous solution of the first salt is alkaline and an aqueous solution of the second salt is neutral or acidic. More preferably, the aqueous first salt solution has a pH in excess of 8 (i.e., pH>8) and the aqueous second salt solution has a pH less than 7 (i.e., pH<7) In addition, the first and second salts of this invention preferably have a solubility in water in excess of 0.8M.

The first salts of this invention include water-soluble carbonates, phosphates, silicates and borates of sodium, ammonium, potassium and lithium, and the second salts of this invention may include water-soluble chlorides, nitrates and sulfates of aluminum, barium, calcium, magnesium and zinc. The precipitates formed from the above first and second salts may include carbonates, phosphates, silicates and borates of aluminum, barium, calcium magnesium and zinc.

Preferred first salts are water-soluble carbonates, phosphates and silicates of sodium, ammonium, potassium and lithium. Preferred second salts are water-soluble chlorides and nitrates of calcium. The precipitates formed from the above preferred first and second salts are carbonates, phosphates and silicates of calcium. Representative examples of the preferred first and second salts of this invention, and the precipitates formed thereby, are set forth in Table 1.

TABLE 1

| Precipitate | First Salt | Second Salt |
|---|---|---|
| $CaCO_3$ | $Na_2CO_3$ | $CaCl_2$ |
| " | $Na_2CO_3$ | $Ca(NO_3)_2$ |
| " | $NH_4HCO_3$ | $CaCl_2$ |
| " | $NH_4HCO_3$ | $Ca(NO_3)_2$ |
| " | $(NH_4)_2CO_3$ | $CaCl_2$ |
| " | $(NH_4)_2CO_3$ | $Ca(NO_3)_2$ |
| $Ca_3(PO_4)_2$ | $Na_2HPO_4$ | $CaCl_2$ |
| " | $Na_2HPO_4$ | $Ca(NO_3)_2$ |
| $CaSiO_3$ | $Na_2SiO_3$ | $CaCl_2$ |
| " | $Na_2SiO_3$ | $Ca(NO_3)_2$ |
| $Ca_2P_4O_7$ | $Na_4P_2O_7$' | $CaCl_2$ |
| " | $Na_4P_2O_7$ | $Ca(NO_3)_2$ |

The first aqueous salt solution may be prepared by dissolving the first salt in water such that the concentration of the aqueous solution ranges from 1 molar (M) to a saturated solution, and preferably from 2M to a saturated solution. The second salt solution may similarly be prepared by dissolving the second salt in water to yield a solution concentration ranging from 1M to a saturated solution, and preferably from 1.5M to a saturated solution. While use of a single first salt and a single second salt is preferred, mixtures of two or more first salts or mixtures of two or more second salts, or various combinations thereof, may also be employed. Thus, a convenient second salt is a mixture of calcium nitrate/ammonium nitrate since it is sold commercially in a five to one molar ratio as the decahydrate.

The dried cellulosic fibers may be contacted with the first and second aqueous salt solutions at ambient temperature and pressure. For example, in the normal operation of a paper mill, utilizing the salt solutions at ambient temperature (i.e., from about 20° C. to about 90° C.) is sufficient. However, should the mill operate in exceptionally cold or warm climates, additional heating or cooling steps may be required. Such heating or cooling steps would be readily apparent to one skilled in this art. For example, the highest filler levels for calcium carbonate are achieved when the temperature during precipitation is above 60° C. One skilled in this art could readily determine the optimal temperature range for achieving the highest filler levels for any given precipitate and corresponding first/second salt combination.

The filled cellulosic fibers of this invention may be used in a conventional manner to make various cellulosic products, including high-ash paper having acceptable opacity and strength. Methods for making various cellulosic paper products are described in James P. Casey, *Pulp and Paper*, 3rd ed., John Wiley & Sons, N.Y., 1981; James E. Kline, *Paper and Paperboard*, Miller Freeman Publications, Inc., San Francisco, Calif., 1982, which references are incorporated herein by reference. Filled cellulosic fibers may also be used for a variety of other purposes, such as fire retardant products including insulation.

The following examples are offered by way of illustration, not limitation.

EXAMPLES

Briefly, Example 1 illustrates a preferred embodiment of the present invention, utilizing sodium carbonate as the first salt and calcium chloride as the second salt, and forming calcium carbonate as the precipitate. Example 2 illustrates the inferior filler levels produced when the order of the salts of Example 1 are reversed. In addition, this example further illustrates that re-swelling the dried cellulosic fibers fails to enhance the retained filler level. Example 3 illustrates a further embodiment of the present invention, utilizing sodium carbonate as the first salt and calcium nitrate as the second salt. Example 4 illustrates the inferior filler results produced when an aqueous solution of the first salt, sodium sulfate, does not have a pH greater than 7. Examples 5–7 illustrate further exemplary embodiments of the present invention. Example 8 illustrates a further comparison with regard to the order of the first and second salts. Example 9 illustrates the ability of the present invention to fill recycled waste paper. Lastly, Example 10 illustrates a further embodiment wherein sodium pyrophosphate is used as the first salt, calcium chloride is used as the second salt, and the precipitate is calcium pyrophosphate.

EXAMPLE 1

Calcium Carbonate Filler

First Salt: Sodium Carbonate-Second Salt: Calcium Chloride

A mass of dry, bleached, softwood fibers (30 g, 7.7% moisture content, Weyerhaeuser Co., Prince Albert, B.C., Canada) was suspended in water at 20° C. and disintegrated (3,000 rpm for 40,000 revolutions ("rev")). The separated fibers were collected by filtration and the moisture content determined. The wet fibers (72% moisture content) were then immersed in an aqueous solution of sodium carbonate such that the final concentration and volume was 2.8M and 500 mL, respectively. After 2.5 hours ("h") at 25° C., the impregnated fibers were collected by centrifugation and added to a vigorously agitated (3,000 rpm, 20,000 rev) aqueous solution of calcium chloride (2M, 1,800 mL) at 63° C. The fibers were then collected by filtration and repeatedly washed with water on a wire screen (150 mesh) until the wash water was clear. The inorganic filler content of the fibers was determined by ignition at 575° C. for 1.5 h, and found to be 12% by weight.

EXAMPLE 2

Calcium Carbonate Filler

First Salt: Calcium Chloride-Second Salt: Sodium Carbonate

Two separate portions (each 14 g) of a commercial, dried, bleached Douglas first pulp (Weyerhaeuser Co., Everett, Wash.) were soaked and broken up in water (1L) for 5 minutes ("min"), dewatered by filtration and dried at 100° C. One of the samples, designated A for alkali treatment, was then immersed in a 10% w/w solution of sodium hydroxide (240 g) at 22° C. for 2 h, recovered by filtration, shaken with water (2L) and again collected by filtration. The pulp was then repeatedly washed with water (4×2L). The other original pulp sample, designated N for no alkali treatment, was soaked in water which did not contain sodium hydroxide, but was otherwise subjected to the same sequence of washing steps as sample A.

Thereafter, samples A and N were collected by filtration and centrifugation, and the moisture contents determined. The wet fibers (59% moisture content) were then separately immersed in aqueous solutions of calcium chloride such that the final concentrations and volumes were 4.8M and 100 mL, respectively. After 1.5 h at 57° C., the impregnated fibers were then separated into equal parts, designated A1, A2, N1 and N2. Each of these four samples were separately added to a vigorously agitated (3,000 rpm, 7,500 rev) aqueous solution of sodium carbonate (3M, 1,700 mL) at 25° C. The fibers were collected by filtration and repeatedly washed with water on a wire screen (150 mesh) until the wash water was clear. The inorganic filler content of the composite fibers was then determined by ignition at 570° C. and found to be 2.7% and 2.2% by weight for sample A1 and A2, respectively. Similarly, samples N1 and N2 were found to contain 3.7% and 2.8% filler by weight, respectively.

EXAMPLE 3

Calcium Carbonate Filler

First Salt: Sodium Carbonate-Second Salt: Calcium Nitrate/Ammonium Nitrate

A mass of dry, bleached soft wood fibers (35 g, 7.7% moisture content, Weyerhaeuser Co., Prince Albert, B.C., Canada) was suspended in water (2L) at 20° C. and disintegrated (3,000 rpm 40,000 rev). The separated fibers were collected by filtration and centrifugation, and the moisture content determined. An aliquot of the wet fibers (29 g, 65% moisture content) was then immersed in an aqueous solution of sodium carbonate such that the final concentration and volume was 3.8M and 127 mL, respectively. After standing overnight, the mixture was heated at 40° C. for 1 h, centrifuged and the impregnated fibers (32 g) collected and added to a high shear mixer containing a filtered aqueous solution of calcium nitrate-ammonium nitrate (5:1) decahydrate (3.6M, 500 mL) at 110° C.–116° C. After 1 min, an aliquot (40 g) was added to a high shear mixer containing water (500 mL) at 20° C. After 10 seconds ("sec"), the suspension was filtered and the collected fibers repeatedly washed with water on a wire screen (150 mesh) until the wash water was clear. After drying at 105° C., the inorganic content of the composite fibers was determined by ignition at 550° C. for 30 min, and found to be 24% by weight.

EXAMPLE 4

Calcium Sulfate Filler

First Salt: Sodium Sulfate-Second Salt: Calcium Nitrate/Ammonium Nitrate

A mass of oven-dried, bleached, soft wood fibers (7 g, Douglas fir, Weyerhaeuser Co., Everett, Wash.) was immersed in an aqueous solution of sodium sulfate (2M, 100 mL) at 40° C. for 5 h. The pH of the suspension was determined to be 6.1, and the fibers were collected by centrifugation. The impregnated fibers were added to a vigorously agitated (3,000 rpm, 7,500 rev) aqueous solution of calcium nitrate-ammonium nitrate (5:1) decahydrate (2.35M, 1,750 mL) at 32° C. The fibers were collected by filtration and repeatedly washed with water on a wire screen (150 mesh) until the wash water was clear. After drying at 105° C., the inorganic content of the composite fibers was determined by ignition at 590° C. for 1 h, and found to be 0.6% by weight.

EXAMPLE 5

Calcium Carbonate Filler

First Salt: Sodium Carbonate-Second Salt: Calcium Nitrate/Ammonium Nitrate

A commercial, never-dried, bleached Douglas fir pulp (Weyerhaeuser Co., Everett, Wash.) was dried (100° C., 16 hours) to a moisture content of 0%, and a sample (17 g) was suspended in water (2L) and disintegrated (3,000 rpm, 2,000 rev). The separated fibers were collected by filtration and centrifugation, and the moisture content determined. The wet fibers (69% moisture content) were then immersed in an aqueous solution of sodium carbonate such that the final concentration and volume was 4M and 160 mL, respectively. After 1 h at 32° C., the impregnated fibers were collected by centrifugation and added to a vigorously agitated (3,000 rpm, 7,500 rev) aqueous solution of calcium nitrate-ammonium nitrate (5:1) decahydrate (3.3M, 1,700 mL) at 52° C–58° C. The fibers were then collected by filtration and repeatedly washed with water on a wire screen (150 mesh) until the wash water was clear. The washed fibers were collected and suspended in water (2 L) and disintegrated (3,000 rpm, 40,000 rev). The fibers were again collected by filtration and repeatedly washed with water on a wire screen (150 mesh) until the wash water was clear. The inorganic content of the fibers was then determined by ignition at 570° C. and found to be 15.4% by weight.

EXAMPLE 6

Calcium Silicate Filler

First Salt: Sodium Metasilicate-Second Salt: Calcium Nitrate/Ammonium Nitrate

A mass of oven-dried, bleached soft wood fibers (7 g, Douglas fir, Weyerhaeuser Co., Everett, Wash.) was immersed in an aqueous solution of sodium metasilicate (2M, 100 mL) at 40° C. for 5 h. The pH of the suspension was determined to be 13.4, and the fibers were collected by centrifugation. The impregnated fibers were added to a vigorously agitated (3,000 rpm, 7,500 rev) aqueous solution of calcium nitrate-ammonium nitrate (5:1) decahydrate (2.35M, 1,750 mL) at 32° C. The fibers were collected by filtration and repeatedly washed with water on a wire screen (150 mesh) until the wash water was clear. After drying at 105° C., the inorganic content of the composite fibers was determined by ignition at 590° C. for 1 h, and found to be 10.5% by weight.

EXAMPLE 7

Calcium Phosphate Filler

First Salt: Sodium Hydrogen Phosphate

Second Salt: Calcium Nitrate/Ammonium Nitrate

A mass of oven-dried, bleached soft wood fibers (7 g, Douglas fir, Weyerhaeuser Co., Everett, Wash.) was immersed in an aqueous solution of sodium hydrogen phosphate (2M, 100 mL) at 40° C. for 5 h. The pH of the suspension was determined to be 8.6, and the fibers were collected by centrifugation. The impregnated fibers were added to a vigorously agitated (3,000 rpm, 7,500 rev) solution of calcium nitrate-ammonium nitrate (5:1) decahydrate (2.35M, 1,750 mL) at 32° C. The fibers were collected by filtration and repeatedly washed with water on a wire screen (150 mesh) until the wash water was clear. After drying at 105° C., the inorganic content of the composite fibers was determined by ignition at 590° C. for 1 h, and found to be 10.7% by weight.

EXAMPLE 8

Calcium Carbonate Filler

A. First Salt: Sodium Carbonate-Second Salt: Calcium Nitrate/Ammonium Nitrate

A mass of oven-dried, bleached, softwood (80%)-hardwood (20%) fibers (6 g) provided by International Paper Co., Ticonderoga, N.Y., was immersed in an aqueous solution of sodium carbonate (3.8M, 152 mL) at 30° C. for 1 h. The fibers were then collected by filtration and centrifugation. The impregnated fibers were added to a vigorously agitated (3,000 rpm, 20,000 rev) aqueous solution of calcium nitrate-ammonium nitrate (5:1) decahydrate (3.2M, 1,300 mL). The fibers were collected by filtration and repeatedly washed with water on wire screen (150 mesh) until the wash water was clear. An aliquot (2.1 g) of these fibers was dried at 105° C. The inorganic content of the composite fibers was determined by ignition at 590° C. for 1 h and was found to be 23.8% by weight.

The remainder of the collected fibers was suspended in water (2 L) and disintegrated (3,000 rpm, 40,000 rev). The fibers were again collected by filtration and repeatedly washed with water on a wire screen (150 mesh) until the wash water was clear. An aliquot (2.4 g) of these fibers was dried at 105° C. The inorganic content of the composite fibers was determined by ignition at 590° C. for 1 h, was now found to be 13.4% by weight.

B. First Salt: Calcium Nitrate/Ammonium Nitrate-Second Salt: Sodium Carbonate

A mass of oven-dried, bleached, softwood (80%)-hardwood (20%) fibers (5 g) provided by International Paper Co., Ticonderoga, N.Y., was immersed in an aqueous solution of calcium nitrate-ammonium nitrate (5:1) decahydrate (2.7M, 125 mL) at 55° C. for 1 h. The fibers were collected by centrifugation. The impregnated fibers were added to a vigorously agitated (3,000 rpm, 20,000 rev) aqueous solution of sodium carbonate (3.8M, 950 mL) at 30° C. The fibers were collected by filtration and repeatedly washed with water on a wire screen (150 mesh) until the wash water was clear. An aliquot (1.3 g) of these fibers was dried at 105° C. The inorganic content of the composite fibers was determined by ignition at 590° C. for 1 h and was found to be 3.1% by weight.

The remainder of the collected fibers was suspended in water (2 L) and disintegrated (3,000 rpm, 40,000 rev). The fibers were again collected by filtration and repeatedly washed with water on a wire screen (150 mesh) until the wash water was clear. An aliquot (1.6 g) of these fibers was dried at 105° C. The inorganic content of the composite fibers was determined by ignition at 590° C. for 1 h and was now found to be 2.8% by weight.

EXAMPLE 9

Calcium Carbonate Filler

First Salt: Sodium Carbonate-Second Salt: Calcium Nitrate/Ammonium Nitrate

A sample (14 g) of oven-dried waste paper (long grain white copy paper, Fore DP, Hammermill Paper Co., Erie, Pa.; ash content 25.2% achieved with polymers and retention aids), was suspended in water (2 L) and disintegrated (3,000 rpm, 10,000 rev). The separated fibers were collected by filtration and centrifugation. The wet fibers were then immersed in an aqueous solution of sodium carbonate such that the final concentration and volume was 4M and 210 mL, respectively. After 1 h at 40° C. the impregnated fibers were collected by centrifugation and separated into 2 equal parts, designated WP1 and WP2. Each portion was separately added to a vigorously agitated (3,000 rpm, 7,500 rev) aqueous solution of calcium nitrate-ammonium nitrate (5:1) decahydrate (2.35M, 1,700 mL) at 60° C. The fibers were collected by filtration and each sample was repeatedly washed with water on a wire screen (150 mesh) until the wash water was clear, and then ashed at 590° C. for 1.5 h. The ash contents found for WP1 and WP2 were 36% and 36.5% by weight, respectively.

Another sample of the waste paper, subjected to the same treatment conditions as above, but with the omission of first and second salt solutions, yielded an ash content of 9% by weight. Thus, of the original 25.2% by weight waste paper ash content, only 9% by weight represents filler firmly attached to the fibers. Accordingly, for samples WP1 and WP2 above, the filler content retained by these samples was 27% (i.e., 36%-9% by weight) and 27.5% (i.e., 36.5%-9%), respectively.

EXAMPLE 10

Calcium Pyrophosphate Filler

First Salt: Sodium Pyrophosphate-Second Salt: Calcium Chloride

A mass of dry, bleached soft wood fibers (3.8 g, 7.7% moisture content, Weyerhaeuser Co., Prince Albert, B.C., Canada) was suspended in water (2 L) at 20° C. and disintegrated (3,000 rpm, 40,000 rev). The separated fibers were collected by filtration and centrifugation, and the moisture content determined. The wet fibers (12.1 g, 71.1% moisture content) were then immersed in an aqueous solution of sodium pyrophosphate decahydrate (31.2 g/18.2 g water) such that the final concentration was 32% w/w overall. After 1 h at 85° C. the pH of the suspension was determined to be 9.6. The impregnated fibers were then collected by filtration and added to a high shear mixer containing an aqueous solution of calcium chloride (4.8M, 500 mL) at 80° C. After 1 min the suspension was filtered and the collected fibers repeatedly washed with water on a wire screen (150 mesh) until the wash water was clear. An aliquot (1 g) was dried at 105° C., the ash content of the composite fibers was determined by ignition at 620° C. for 24 h, and found to be 36.4% by weight. The remainder of the fibers were suspended in water (2 L) and disintegrated (3,000 rpm, 20,000 rev). The fibers were then collected and repeatedly washed with water on a wire screen (150 mesh) until the wash water was clear. After drying at 105° C., the ash content of the composite fiber was determined by ignition at 620° C. for 24 h, and found to be 31.6% by weight.

While this invention has been shown and described with reference to various preferred embodiments, it will be understood by those skilled in the art that various changes or modifications in form and detail may be made without departing from the spirit and scope of this invention.

We claim:

1. A method for making a filled cellulosic fiber, comprising contacting a dried cellulosic fiber with a first salt, wherein the first salt is characterized by having an alkaline pH in water; followed by contacting the cellulosic fiber with a second salt such that the first and second salts combine to form calcium carbonate a precipitate within the cellulosic fiber to yield the filled cellulosic fiber and a water-soluble co-product, and wherein the second salt is characterized by having a neutral or acid pH in water.

2. The method of claim 1 further comprising washing the filled cellulosic fiber to remove to the water soluble co-product.

3. The method of claim 1, further comprising drying the filled cellulosic fibers.

4. The method of claim 1 wherein the first salt and the second salt are aqueous solutions.

5. The method of claim 4 wherein the aqueous solution of the first salt has a pH of greater than 7.

6. The method of claim 4 wherein the aqueous solution of the first salt has a pH of greater than 8.

7. The method of claim 4 herein the aqueous solution of the second salt has a pH of less than 7.

8. The method of claim 4 wherein the concentration of the aqueous solution of the first salt and of the second salt ranges from 1M to a saturated solution.

9. The method of claim 1 wherein the first salt is selected from water-soluble carbonates, phosphates and silicates of sodium, ammonium, potassium and lithium.

10. The method of claim 1 wherein the second salt is selected from water-soluble chlorides and nitrates of calcium.

11. The method of claim 1 wherein the first salt is sodium carbonate, and the second salt is calcium chloride or calcium nitrate.

12. The method of claim 1 further comprising the step of making the filled cellulosic fiber into a filled cellulosic product.

13. The method of claim 12 wherein the filled cellulosic product is paper.

14. A method for making a filled cellulosic fiber from a dried cellulosic fiber, comprising:

contacting the dried cellulosic fiber with an alkaline aqueous solution containing a first salt to yield a wetted fiber;

contacting the wetted fiber with a neutral or acid aqueous solution containing a second salt such that the first salt and second salt combine to form a calcium carbonate precipitate within the cell wall of the wetted fiber to yield a filled cellulosic fiber and a water soluble co-product; and washing the filled cellulosic fiber with water to remove the water soluble co-product and any unbound or unattached precipitate.

15. The method of claim 14 further including, after the washing step, drying the filled cellulosic fibers.

16. The method of claim 14 further including, after the washing step, forming paper from the washed, filled cellulosic fiber.

17. The method of claim 14 wherein the first salt is selected from water-soluble carbonates, phosphates and silicates of sodium, ammonium, potassium and lithium.

18. The method of claim 14 wherein the second salt is selected from water-soluble chlorides and nitrates of calcium.

19. The method of claim 14 wherein the first salt is sodium carbonate and the second salt is calcium chloride or calcium nitrate.

* * * * *